US008424309B2

(12) United States Patent
Liau

(10) Patent No.: US 8,424,309 B2
(45) Date of Patent: Apr. 23, 2013

(54) CONTINUOUS POWER SOURCE OF STEAM IN CIRCULATION, AND POWER REINFORCEMENT

(76) Inventor: George Uh-Schu Liau, Markham (CA)

( * ) Notice: Subject to any disclaimer, the term of this patent is extended or adjusted under 35 U.S.C. 154(b) by 959 days.

(21) Appl. No.: 12/498,560

(22) Filed: Jul. 7, 2009

(65) Prior Publication Data

US 2009/0266074 A1 Oct. 29, 2009

Related U.S. Application Data

(63) Continuation-in-part of application No. PCT/CA2007/001153, filed on Jun. 27, 2007.

(51) Int. Cl.
*F01K 13/00* (2006.01)

(52) U.S. Cl.
USPC ..... 60/676

(58) Field of Classification Search ..... 60/676, 60/670; 122/459, 367.1–367.3, 235.11, 235.23, 122/247, 248
See application file for complete search history.

(56) References Cited

U.S. PATENT DOCUMENTS 3,563,212 A * 2/1971 Hoagland ..... 122/250 R
4,211,211 A 7/1980 Toomey et al. ..... 126/439
4,491,125 A 1/1985 Sainsbury ..... 126/424
4,532,412 A 7/1985 Birocchi ..... 219/271
5,347,814 A * 9/1994 Kemmer et al. ..... 60/676

FOREIGN PATENT DOCUMENTS

EP 0760059 5/2006

OTHER PUBLICATIONS

Pages from Textbook, re the "Carnot Vapor Cycle", pp. 522-529.

* cited by examiner

*Primary Examiner* — Thomas Denion
*Assistant Examiner* — Jonathan Matthias
(74) *Attorney, Agent, or Firm* — Walter J. Tencza, Jr.

(57) ABSTRACT

A first and any further number of pipe steamer devices are provided. Each pipe steamer device may include a ring which has a steam pipe connection opening, a steam pipe, a water pipe, and a heating element. Each steam pipe may have a proximal end which is connected to the appropriate steam pipe connection opening and a distal end which is connected to a proximal end of the appropriate water pipe. Each water pipe may have a distal end which is located closer to the appropriate heating element than its proximal end. Each of the first steam pipe and the first water pipe may have a spiral shape. The apparatus also include a first power reinforcer device which may include a first sack and a second sack. The first power reinforcer device may be connected to a first pipe steamer device and a second pipe steamer device, such that steam from the first pipe steamer device flows into the first sack and flows out of the first sack into the first pipe steamer device, and steam from the second pipe steamer device flows into the second sack and out of the second sack into the second pipe steamer.

19 Claims, 5 Drawing Sheets

CONTINUOUS POWER SOURCE OF STEAM IN CIRCULATION, AND POWER REINFORCEMENT

CROSS REFERENCE TO RELATED APPLICATIONS

The present application is a continuation in part of and claims the priority of PCT patent application serial no. PCT/CA2007/001153, International Filing Date Jun. 27, 2007, claiming the priority of Canadian patent application 2,575,539, filed on Jan. 8, 2007, titled "A CONTINUOUS POWER SOURCE OF STEAM IN CIRCULATION, AND POWER REINFORCEMENT. The present application claims the priority of both PCT/CA2007/001153 and Canadian patent application 2,575,539.

FIELD OF THE INVENTION

This invention relates to improved methods and apparatus concerning power generation techniques.

BACKGROUND OF THE INVENTION

There are various devices known in the prior art for generating power. In conventional steam power generation an initial steam momentum is used to generate the revolving power. To keep the revolving power going, fuel energy is consumed continuously to heat water into steam. So far steam cannot be recycled without a condensing process, and active steam momentum cannot be reused continuously. For steam will slow down and become cool, and active steam momentum cannot be harnessed mechanically in circulation.

SUMMARY OF THE INVENTION

In one or more embodiments of the present invention, steam power is recycled. In at least one embodiment, water is kept above its boiling point of one hundred degrees Celsius (two hundred and twelve degrees Fahrenheit) in an enclosed pipe system without allowing the process of condensation to occur.

In order to save energy and reduce heating cost and keep the revolving power going, without a condensing process, a steam circulation system apparatus and method is provided in one or more embodiments.

One or more embodiments, generate revolving power by recycling steam power without a condensing process; generate and keep steam above its boiling point with a minimum input of energy; reinforce steam momentum; and harness and guide active steam momentum in circulation.

In one or more embodiments of the present invention an apparatus is provided comprising a first pipe steamer device. The first pipe steamer device may include a first ring which is closed except for a first set of openings and a first steam pipe connection opening. The first pipe steamer device may also include a first steam pipe, a first water pipe, and a first heating element. The first steam pipe may have a proximal end which is connected to the first steam pipe connection opening and a distal end which is connected to a proximal end of the first water pipe. The first water pipe may have a distal end which is located closer to the heating element than its proximal end.

Each of the first steam pipe and the first water pipe may have a spiral shape. The first pipe steamer device may be further comprised of a first steam pipe container, wherein the first steam pipe is located in the first steam pipe container; and a first water pipe container, wherein the first water pipe is located in the first water pipe container. Each of the first steam pipe container and the first water pipe container may have a bowl shape, and the first steam pipe container may be connected to the first water pipe container to form a first combination device container which has an hourglass shape.

The apparatus may be comprised of a second pipe steamer device, or any further number of identical or similar pipe steamer devices. The second pipe steamer device may be comprised of a second ring which is closed except for a second set of openings and a second steam pipe connection opening. The second pipe steamer device may be comprised of a second steam pipe, a second water pipe, and a second heating element. The second steam pipe may have a proximal end which is connected to the second steam pipe connection opening and a distal end which is connected to a proximal end of the second water pipe. The second water pipe may have a distal end which is located closer to the second heating element than its proximal end.

The apparatus may be further comprised of a first power reinforcer device comprised of a first sack and a second sack. The first power reinforcer device may be connected to the first pipe steamer device and the second pipe steamer device, such that steam from the first pipe steamer flows into the first sack and flows out of the first sack into the first pipe steamer, and steam from the second pipe steamer flows into the second sack and out of the second sack into the second pipe steamer.

The apparatus may be further comprised of a first steam application station connected to the first pipe steamer device. The first steam application station receives steam from the first pipe steamer device and generates electrical power using the steam from the first pipe steamer device. The first steam application station may direct steam back to the first pipe steamer device.

In one or more embodiments, the present invention provides a method comprising heating water in a first water pipe located in a first water pipe container so that the water in the first water pipe turns into steam. The method may also include directing steam from the first water pipe into a first steam pipe located in a first steam pipe container; directing steam from the first steam pipe into a first steam pipe ring; and supplying steam from the first steam pipe ring to a first steam application station. The first steam application station may receive steam from the first steam pipe ring and generate electrical power using steam from the first steam pipe ring. The method may further be comprised of directing steam from the first steam application station back to the first steam pipe ring.

The method may further include directing steam from the first steam pipe ring to a first sack of a first power reinforcer, and directing steam from the first sack of the first power reinforcer back into the first steam pipe ring.

In one or more embodiments of the present invention, the method may also include heating water in a second water pipe located in a second water pipe container so that the water in the second water pipe turns into steam. The method may also include directing steam from the second water pipe into a second steam pipe located in a second steam pipe container, directing steam from the second steam pipe into a second steam pipe ring, and supplying steam from the second steam pipe ring to a second steam application station. The second steam application station may receive steam from the second steam pipe ring and generate electrical power using steam from the second steam pipe ring. The method may also include directing steam from the second steam application station back to the second steam pipe ring.

In one or more embodiments, the method may also include directing steam from the first steam pipe ring to a first sack of a first power reinforcer, directing steam from the first sack of the first power reinforcer back into the first steam pipe ring, directing steam from the second steam pipe ring to a second sack of the first power reinforcer; and directing steam from the second sack of the first power reinforcer back into the second steam pipe ring.

DETAILED DESCRIPTION OF THE DRAWINGS

Figure 1:
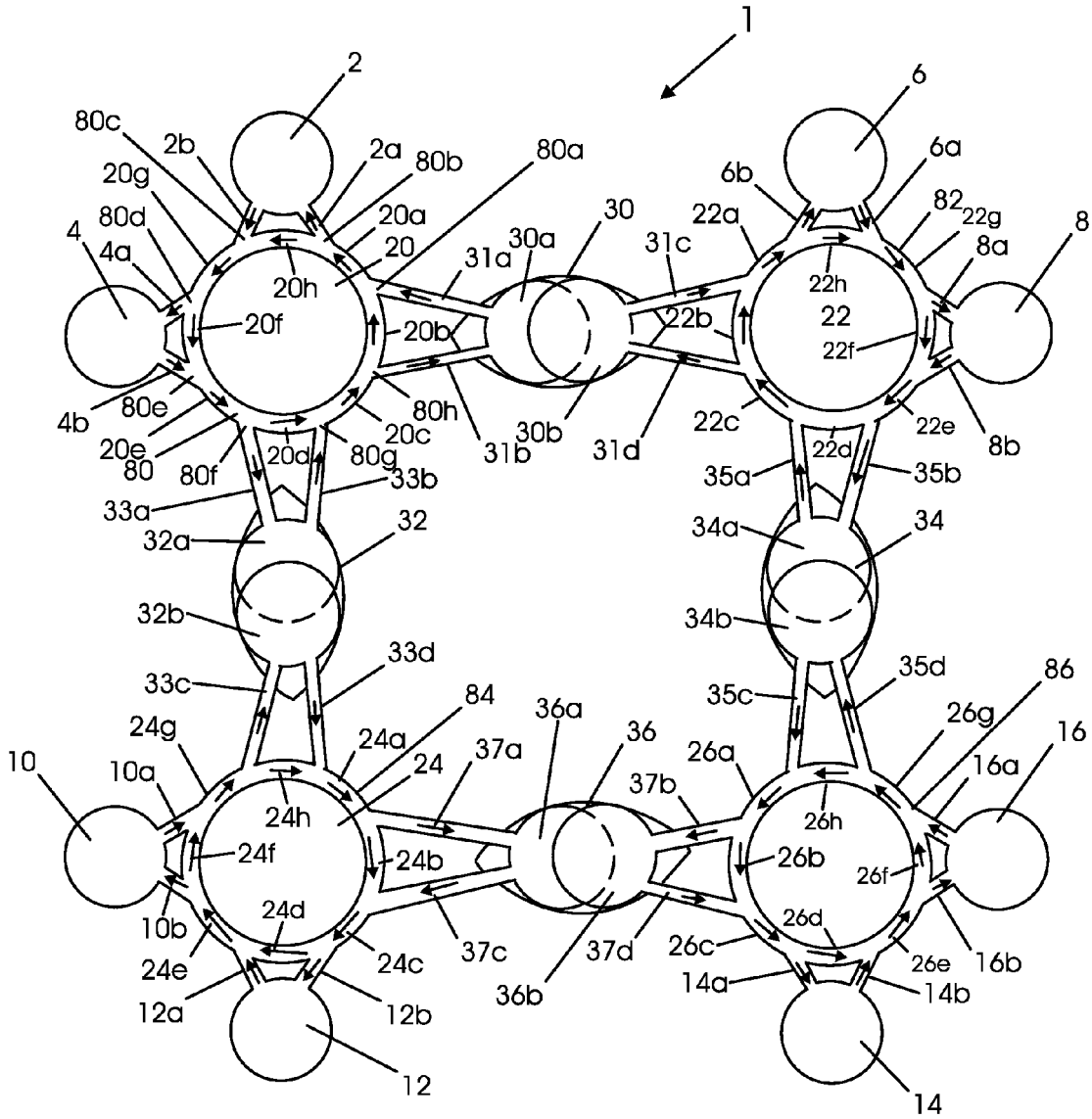
FIG. 1 shows a simplified diagram of a steam circulation apparatus and system in accordance with an embodiment of the present invention.

FIG. 1 shows a simplified diagram of a steam circulation apparatus and system 1 in accordance with an embodiment of the present invention.

The steam circulation apparatus and system 1 includes steam application stations 2, 4, 6, 8, 10, 12, 14, and 16, pipe steamers (or pipe steamer devices) 20, 22, 24, and 26, and power reinforcers (or power reinforcer devices) 30, 32, 34, and 36. Each of steam application stations 2, 4, 6, 8, 10, 12, 14, and 16 may be identical, each of pipe steamers 20, 22, 24, and 26 may be identical, and each of power reinforcers 30, 32, 34, and 36 may be identical.

Figure 3:
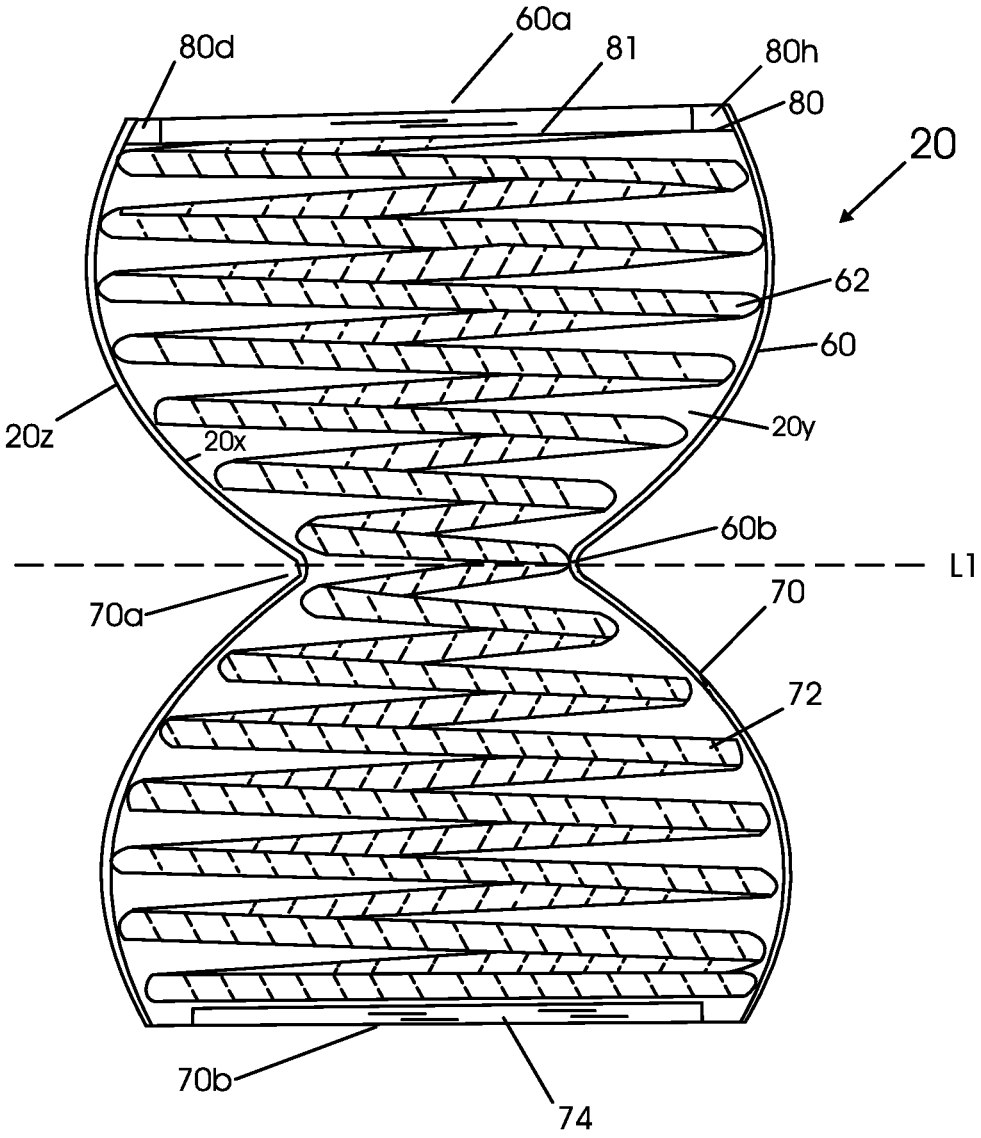
FIG. 3 shows a side view or cross sectional view of a pipe steamer for use in the steam circulation apparatus and system of FIG. 1.
Figure 4:
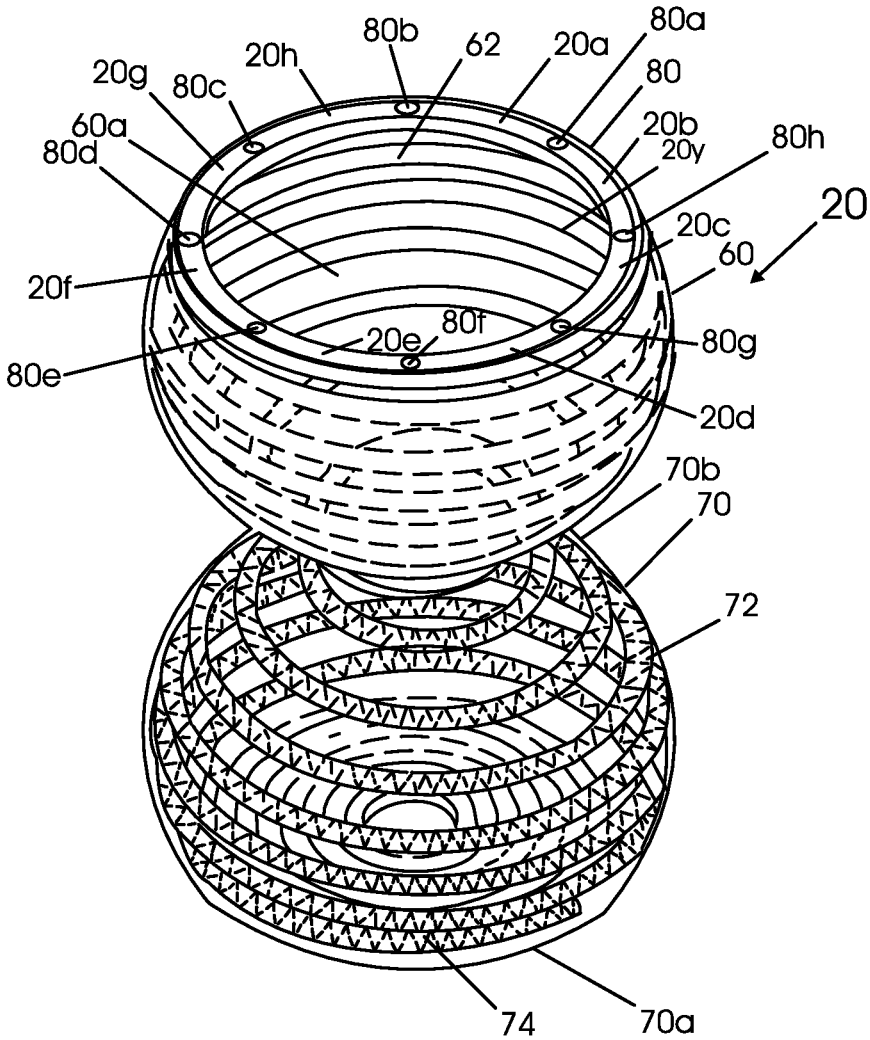
FIG. 4 shows a top perspective view of the pipe steamer of FIG. 3.

FIG. 1 does not show all of the components of the pipe steamers 20, 22, 24, and 26. FIG. 1 is a simplified diagram to explain flow of steam and the actual appearance of the pipe steamers, such as pipe steamer 20, may be different, such as for example, as shown in FIGS. 3 and 4. Further details concerning pipe steamer 20 are shown in FIGS. 3 and 4. The pipe steamers 22, 24, and 26 may be similar to or identical to the pipe steamer 20. FIG. 1 shows steam pipe rings or circles 80, 82, 84, and 86, of pipe steamers 20, 22, 24, and 26, respectively. Each steam pipe circle of 80, 82, 84, and 86 is a ring which is closed except for inlet/outlet openings. For example, steam pipe circle 80 is a ring which has inlet/outlet openings 80*a*, 80*b*, 80*c*, 80*d*, 80*e*, 80*f*, 80*g*, and 80*h*, shown by FIG. 1 and FIG. 4. Each of the steam pipe rings or circles 80, 82, 84, and 86 may not be perfectly circular, although a circular configuration or shape is preferred.

In each pipe steamer of 20, 22, 24, and 26, such as for example, pipe steamer 20, there is a steam pipe, such as steam pipe 62 for pipe steamers 20 shown in FIG. 3. The steam pipe 62 has an end which is connected to an opening 81, whose location is shown in FIG. 3, in the steam pipe circle 80. Water inside the water pipe 72 is heated into steam either by the electric heating element 74 or by an furnace, not shown, which would be located underneath the bottom 70*b* of the water pipe container 70. Steam from the water pipe 72 goes into the steam pipe 62 and then up entering the opening 81 of the steam pipe circle 80.

The steam application station 2 is connected by pipe 2*a* to the intersection of pipes 20*a* and 20*h* of the pipe steamer 20. The steam application station 2 is connected by pipe 2*b* to the intersection of pipes 20*g* and 20*h* of the pipe steamer 20.

The steam application station 4 is connected by pipe 4*a* to the intersection of pipes 20*g* and 20*f* of the pipe steamer 20. The steam application station 4 is connected by pipe 4*b* to the intersection of pipes 20*f* and 20*e* of the pipe steamer 20.

The steam application station 6 is connected by pipe 6*a* to the intersection of pipes 22*g* and 22*h* of the pipe steamer 22. The steam application station 6 is connected by pipe 6*b* to the intersection of pipes 22*a* and 22*h* of the pipe steamer 22.

The steam application station 8 is connected by pipe 8*a* to the intersection of pipes 22*g* and 22*f* of the pipe steamer 22. The steam application station 8 is connected by pipe 8*b* to the intersection of pipes 22*f* and 22*e* of the pipe steamer 20.

The steam application station 10 is connected by pipe 10*a* to the intersection of pipes 24*g* and 24*f* of the pipe steamer 24. The steam application station 10 is connected by pipe 10*b* to the intersection of pipes 24*f* and 24*e* of the pipe steamer 24.

The steam application station 12 is connected by pipe 12*a* to the intersection of pipes 24*e* and 24*d* of the pipe steamer 24. The steam application station 12 is connected by pipe 12*b* to the intersection of pipes 24*d* and 24*c* of the pipe steamer 24.

The steam application station 14 is connected by pipe 14*a* to the intersection of pipes 26*c* and 26*d* of the pipe steamer 26. The steam application station 14 is connected by pipe 14*b* to the intersection of pipes 26*d* and 26*e* of the pipe steamer 26.

The steam application station 16 is connected by pipe 16*a* to the intersection of pipes 26*g* and 26*f* of the pipe steamer 26. The steam application station 16 is connected by pipe 16*b* to the intersection of pipes 26*f* and 26*e* of the pipe steamer 24.

The power reinforcer 30 is connected by pipe 31*a* to the intersection of pipes 20*a* and 20*b* of the pipe steamer 20. The power reinforcer 30 is connected by pipe 31*b* to the intersection of pipes 20*b* and 20*c* of the pipe steamer 20. The power reinforcer 30 is connected by pipe 31*c* to the intersection of pipes 22*a* and 22*b* of the pipe steamer 22. The power reinforcer 30 is connected by pipe 31*d* to the intersection of pipes 22*b* and 22*c* of the pipe steamer 22. The power reinforcer 30 includes sacks 30*a* and 30*b*.

The power reinforcer 32 is connected by pipe 33*a* to the intersection of pipes 20*e* and 20*d* of the pipe steamer 20. The power reinforcer 32 is connected by pipe 33*b* to the intersection of pipes 20*d* and 20*c* of the pipe steamer 20. The power reinforcer 32 is connected by pipe 33*c* to the intersection of pipes 24*g* and 24*h* of the pipe steamer 24. The power reinforcer 32 is connected by pipe 33*d* to the intersection of pipes 24*h* and 24*a* of the pipe steamer 24. The power reinforcer 32 includes sacks 32*a* and 32*b*.

The power reinforcer 34 is connected by pipe 35*a* to the intersection of pipes 22*c* and 22*d* of the pipe steamer 22. The power reinforcer 34 is connected by pipe 35*b* to the intersection of pipes 22*d* and 22*e* of the pipe steamer 22. The power reinforcer 34 is connected by pipe 35*c* to the intersection of pipes 26*a* and 26*h* of the pipe steamer 26. The power reinforcer 34 is connected by pipe 35*d* to the intersection of pipes 26*h* and 26*g* of the pipe steamer 26. The power reinforcer 34 includes sacks 34*a* and 34*b*.

The power reinforcer 36 is connected by pipe 37*a* to the intersection of pipes 24*a* and 24*b* of the pipe steamer 24. The power reinforcer 36 is connected by pipe 37*c* to the intersection of pipes 24*b* and 24*c* of the pipe steamer 24. The power reinforcer 36 is connected by pipe 37*b* to the intersection of pipes 26*a* and 26*b* of the pipe steamer 26. The power reinforcer 36 is connected by pipe 37*d* to the intersection of pipes 26*b* and 26*c* of the pipe steamer 26. The power reinforcer 36 includes sacks 36*a* and 36*b*.

In the diagram of FIG. 1, arrows show the direction of the flow of gas, such as, for example, steam or water vapor through the apparatus and system 1. The arrows are also a simplified representation of one way flow funnels or one way flow valves.

Gas from steam application station 2 flows through pipe 2*b*, into pipe 20*g*, and then splits into either pipe 4*a* or 20*f*. Gas flowing into pipe 4*a* flows into steam application station 4. Gas flowing through pipe 20*f* joins, merges or mixes with gas flowing out of steam application station 4. Gas from pipes 4*b* and 20*f* merges into pipe 20*e*. Gas flowing from pipe 20*e* flows into pipe 33*a* and then into sack 32*a* of the power reinforcer 32, or flows into pipe 20*d*. Gas flowing into pipe 20*d* merges with gas flowing out of the power reinforcer 32 from pipe 33*b*. Gas from pipes 20*d* and 33*b* merges into pipe 20*c*. Gas flowing from pipe 20*c* splits into pipe 31*b* and into sack 30*a* of the power reinforcer 30 or flows into pipe 20*b*. Gas flowing through pipe 20*b* merges in pipe 20*a* with gas from pipe 31*a* flowing out of sack 30*a* of power reinforcer 30. Gas from pipe 20*a* splits into pipes 20*h* and 2*a*. Gas from pipe 2*a* enters steam application station 2.

Similarly, gas from steam application station 6 flows through pipe 6*a*, into pipe 22*g*, and then splits into either pipe 8*a*, or 22*f*. Gas flowing into pipe 8*a* flows into steam application station 8. Gas flowing through pipe 22*f* joins, merges or mixes with gas flowing out of steam application station 8 through pipe 8*b*. Gas from pipes 8*b* and 22*f* merges into pipe 22*e*. Gas flowing from pipe 22*e* splits into either gas flowing through pipe 35*b* and into sack 34*a* or into pipe 22*d*. Gas flowing into pipe 22*d* merges with gas flowing out of the power reinforcer 34 from pipe 35*a*. Gas from pipes 22*d* and 35*a* merges into pipe 22*c*. Gas flowing from pipe 22*c* splits into pipe 31*d* and into sack 30*b* of the power reinforcer 30 or flows into pipe 22*b*. Gas flowing through pipe 22*b* merges in pipe 22*a* with gas from pipe 31*c* flowing out of sack 30*b* of power reinforcer 30. Gas from pipe 22*a* splits into pipes 6*b* and 22*h*. Gas from pipe 6*b* enters steam application station 6.

Similarly, gas from steam application station 16 flows through pipe 16*a*, into pipe 26*g*, merging with gas from pipe 26*f*. Gas from pipe 26*g* splits into either pipe 35*d* or pipe 26*h*. Gas flowing into pipe 35*d* flows into sack 34*b* of the power reinforcer 34. Gas flowing through pipe 35*c* from the sack 34*b* of the power reinforcer 34 joins, merges or mixes with gas flowing from from pipe 26*h*, into pipe 26*a*. Gas from pipe 26*a* splits into pipes 37*b* and 26*b*. Gas flowing into pipe 37*b* flows into sack 36*b* of power reinforcer 36. Gas flowing from sack 36*b* flows into pipe 37*d* and joins with gas from pipe 26*b* into pipe 26*c*. Gas flowing from pipe 26*c* splits into gas in pipe 14*a* and pipe 26*d*. Gas from pipe 14*a* flows into steam application station 14. Gas from steam application station 14 flows into pipe 14*b* and joins with gas from pipe 26*d* into pipe 26*e*. Gas from pipe 26*e* splits into pipe 26*f* and 16*b*. Gas flowing in pipe 16*b* flows into steam application station 16.

Similarly, gas from steam application station 12 flows through pipe 12*a*, into pipe 24*e*, merging with gas from pipe 24*d*. Gas from pipe 24*e* splits into either pipe 10*b* or pipe 24*f*. Gas flowing into pipe 10*b* flows into steam application station 10. Gas flowing through pipe 10*a* from the steam application station 10 joins, merges or mixes with gas flowing from pipe 24*f*, into pipe 24*g*. Gas from pipe 24*g* splits into pipes 33*c* and 24*h*. Gas flowing into pipe 33*c* flows into sack 32*b* of power reinforcer 32. Gas flowing from sack 32*b* flows into pipe 33*d* and joins with gas from pipe 24*h* into pipe 24*a*. Gas flowing from pipe 24*a* splits into gas in pipe 37*a* and pipe 24*b*. Gas from pipe 37*a* flows into sack 36*a* of the power reinforcer 36.

Figure 2:
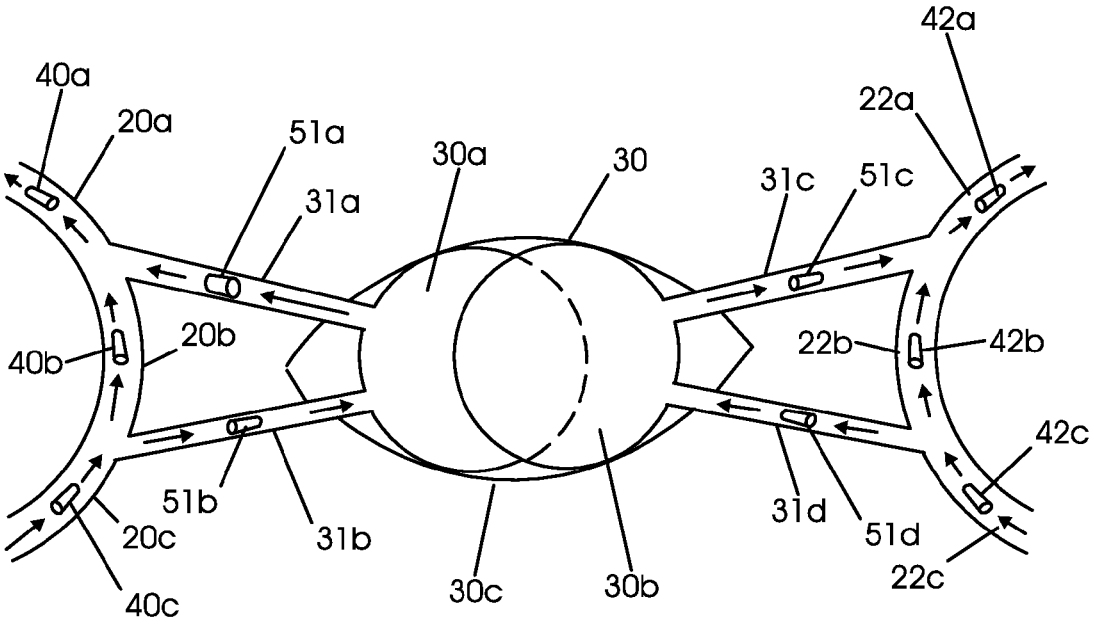
FIG. 2 shows a more detailed close up view of part of the diagram of FIG. 1, along with depictions of one way gas flow funnels or gas valves.

Each arrow in the diagram of FIG. 1 indicates gas flow and is a simplistic representation of a one way gas funnel or gas valve, such that gas can only flow in the direction of the arrows. FIG. 2 shows a somewhat more detailed representation of part of the diagram of FIG. 1. FIG. 2 shows simplified representations of one way gas valves or funnels 40*a*, 40*b*, 40*c*, 51*a*, 51 b, 51*c*, 51*d*, 42*a*, 42*b*, and 42*c*, inside of pipes 20*a*, 20*b*, 20*c*, 31*a*, 31*b*, 31*c*, 31*d*, 22*a*, 22*b*, and 22*c*, respectively.

The embodiment of FIG. 1 is an example, and there may be more steam application stations, power reinforcers, and pipe steamers than shown in FIG. 1.

FIG. 3 shows a cross sectional view of the pipe steamer 20 for use in the steam circulation apparatus and system 1 of FIG. 1. FIG. 4 shows a top perspective view of the pipe steamer 20 of FIG. 3. The pipe steamer 20 includes a steam pipe container 60 and a water pipe container 70. The steam pipe container 60 has located therein a helical steam pipe 62 which winds its way along an inner wall of the steam pipe container 60. The water pipe container 70 has located therein a helical water pipe 72 which winds its way along an inner wall of the water pipe container 70. The pipe steamer 20 also includes an electric heating element 74 which wraps around the water pipe 72. The water pipe 72 is connected to the steam pipe 62 at a junction of the water pipe container 70 and the steam pipe container 60. The water pipe container 70 and the steam pipe container 60 are joined together. Water can be refilled through a valve, which can be located anywhere on the steam pipe 62.

The water pipe 72 may be spiral or helical and may be wound inside the pipe steamer 20 or pipe steamer device 20 adjacent to the inner wall 20*x* in the water pipe container 70 below the dashed line L1 shown in FIG. 3. The steam pipe 62 may also be spiral or helical and may be wound in the pipe steamer 20 adjacent to the inner wall 20*x* in the steam pipe container 60 above the dashed line L1 shown in FIG. 3. The water pipe 72 may have an end which is connected to the steam pipe 62 at about the location of the dashed line L1. The steam pipe container 60 may be substantially in the shape of a bowl or a ball or sphere with an opening at the top 60*a* and a junction area at a bottom 60*b* which corresponds to a top 70*a* of water pipe container 70. The water pipe container 70 may be substantially in the shape of bowl or a ball or sphere with an junction area at the top 70*a* which corresponds to the bottom 60*b* of the steam pipe container 60 and closed at the bottom by 70*b*. The overall shape of the pipe steamer 20 is an hour glass with the hourglass shape having a sealed inner chamber 20*y*, enclosed by wall 20*x*, with the exception of the top 60*a*. At a place where there is no sunlight, a removable and flexible rubber cover will be available to cover the top 60*a* of the pipe steamer 20 (and also covers for pipe steamers 22, 24, and 26) just underneath the steam pipe circle 80.

At the top of the steam pipe 62 there is a steam pipe circle 80. There are outlets/inlets, such as outlet/inlets 80*a*, 80*b*, 80*c*, 80*d*, 80*e*, 80*f*, 80*g*, and 80*h*. Each outlet/inlet may be used as either an outlet or an inlet. For example, steam application station 2 may be connected via pipe 2*a* through inlet/outlet 80*b* to a junction of pipe 20*a* and 20*h* of the steam pipe circle 80 of the pipe steamer 20. Steam application station 2 may be connected via pipe 2*b* through inlet/outlet 80*c* to a junction of pipe 20*g* and 20*h*. Other steam application stations (of steam application stations 4, 6, 8, 10, 12, 14, and 16) may be connected to the appropriate pipe steamer or steamers (of pipe steamers 20, 22, 24, and 26) in a similar manner through appropriate outlet/inlets.

Power reinforcers 30, 32, 34, and 36 may be connected to the appropriate pipe steamer in a similar manner. For example, pipe 31*a* may connect to the inlet/outlet 80*a* at the junction of pipes 20*a* and 20*b* to connect power reinforcer 30 and its sack 30*a* to the pipe steamer 20 as shown in FIG. 1. Similarly, pipe 31*b* may connect to the inlet/outlet 80*h* at the junction of pipes 80*a* and 80*h* to connect power reinforcer 30 and its sack 30*a* to the pipe steamer 20 as shown in FIG. 1. Other power reinforcers (of 32, 34, and 36) may be connected with inlet/outlets or inlet/outlet ports of appropriate steam pipe circles (of pipe steamers 20, 22, 24, and 26 in a similar manner).

To generate initial steam momentum, maintain steam mass, and keep steam power active above the boiling point with a minimum input of energy, each of the pipe steamers 20, 22, 24, and 26, is designed as follows. Unlike prior known conventional boilers, the water pipe container 70 of the pipe steamer 20 in accordance with one or more embodiments of the present invention, heats up water into steam inside a water pipe 72, which is an enclosed spiral or helical shaped pipe, winding around the inside wall of the water pipe container 70. The pipe steamer 20 (and identical pipe steamers 22, 24, and 26 can be heated by a furnace of natural gas, coal, or geothermal heat at bottom 70*a* of the water pipe container 70 shown in FIG. 4. The heat source or furnace may be provided from outside the pipe steamer 20, or by electric heating element, 74 which may be located inside the pipe steamer 20 as shown in FIGS. 3 and 4. Steam in the steam pipe container 60 shown in FIGS. 3 and 4, is kept above the boiling point. When the temperature in the steam pipe container 60 drops down to the boiling point, a source of heat, such as heating element 74 is turned on again until the temperature in the steam pipe container 60 of pipe steamer 20 reaches a preset upper limit, such as for example six hundred degrees Celsius. The pipe steamer 20 (and pipe steamer 22, 24, and 26) has insulation 20*z* which to some extent will keep the steam temperature above the boiling point for a period of time without input of energy, i.e. without turning on the heating element 74.

The power reinforcers 30, 32, 34, and 36 are shown in FIG. 1. Each of the power reinforcers 30, 32, 34, and 36 implement a steam pushing effect. The steam pushing effect is generated by the two steam sacks, in each of the power reinforcers 30, 32, 34, and 36. For example, two sacks 30*a* and 30*b*, contained in power reinforcer 30, squeeze each other in turn to convert steam expansion pressure into steam momentum. When one sack is full of steam with inlet open and outlet closed, another sack is squeezed with inlet closed and outlet open. The steam momentum is then created by the thrust of squeezed out steam. Each of the sacks 30*a* and 30*b* can be made of a soft but tough material, such as silk coated with rubber.

In one embodiment the full size of each steam sack, of power reinforcers 30, 32, 34, and 36, such as each of sacks 30*a* and 30*b*, is about three quarters of the appropriate power reinforcer container, such as power reinforcer container 30*c* for power reinforcer 30, shown in FIG. 2.

Steam sacks 30*a* and 30*b*, are connected to two different steam pipe circles, similar to 80 for pipe steamer 20, such as with inlet pipes, 31*b* and 31*d*, shown in FIG. 2, for steam coming into steam sacks, 30*a* and 30*b*, respectively, from pipe steamers 20 and 22 respectively, and outlet pipes, 31*a* and 31*c*, for steam going back to pipe steamers 20 and 22, respectively.

Figure 5:
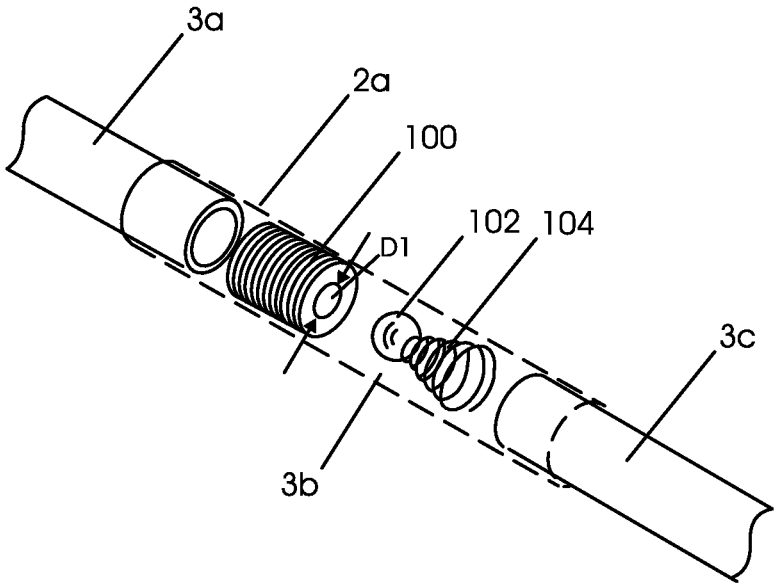
FIG. 5 shows a transparent view of the inside of a pipe for use in the apparatus and system of FIG. 1.

In each of the pipes 2*a*-2*b*, 4*a*-4*b*, 6*a*-6*b*, 8*a*-8*b*, 10*a*-*b*, 12*a*-*b*, 14*a*-*b*, 16*a*-*b*, 20*a*-*h*, 22*a*-*h*, 24*a*-*h*, and 26*a*-*h*, is located a one way gas valve or one way gas flow funnel. Each of these gas valves or gas funnels may be of a form shown in FIG. 5 for pipe 2*a*. The pipe 2*a* is shown having portions 3*a*, 3*b*, and 3*c*, with portion 3*b* being shown as transparent so that an electromagnetic tube 100, a solid sphere 102, and spring 104 can be seen. The portion 3*b* may be a rubber hose section inside of the pipe 2*a*.

The magnetic tube 100 may have an inner diameter D1 which may be slightly smaller than an outer diameter of the solid sphere, 102, which is smaller than the inner diameter of the central portion 3*b* or rubber hose. When electric power for electromagnetic tube 100, is switched on, sphere 102, is attracted to electromagnetic tubes 100, and blocks the passage of steam.

The passage of steam, to and from steam sacks within a power reinforcer, such as to and form steam sacks 30*a* and 30*b* of power reinforcer 30, is controlled by electromagnetic power applied to electromagnetic tube 100 and tubes identical to tube 100 in each of the pipes 2*a*-2*b*, 4*a*-4*b*, 6*a*-6*b*, 8*a*-8*b*, 10*a*-*b*, 12*a*-*b*, 14*a*-*b*, 16*a*-*b*, at a location such as 51*a*-*d* in FIG. 2, as follows. Referring to power reinforcer 30 as an example, in a first state, when the steam sack 30*b* has inlet pipe 31*d* open, and the outlet pipe, 31*c* blocked; the other steam sack, 30*a*, has its inlet pipe, 31*b*, blocked, and its outlet pipe, 31*a*, open. In a second state, when the steam sack 30*b*, has its inlet pipe, 31*d* blocked and the outlet pipe 31*c* open, the other steam sack 30*a* has its inlet pipe 31*b* open, and its outlet pipe 31*a* blocked.

With these two different states alternating, two steam sacks, 30*b* and 30*a*, squeeze each other in turn to push steam forward inside two steam pipe circles, of pipe steamers 20 and 22, connected on two sides of the power reinforcer, 30.

When steam mass is maximized in the steam circulation system, 1 of FIG. 11 the strongest steam pushing effect is generated by the maximum squeezing effect. In order to prevent excessive steam pressure in the system, there will be a pressure relief valve on each of the pipe sections 2*b*, 4*b*, 6*a*, 8*b*, 10*a*, 12*a*, 14*b*, and 16*a*.

In the steam circulation apparatus and system 1 of FIG. 1 power reinforcers (of 30, 32, 34, and 36) are installed on two sides of each pipe steamer (of pipe steamers 20, 22, 24, and 26) to generate a greater pushing effect to push steam forward inside each steam pipe circle, such as steam pipe circle 80 of pipe steamer 20. To further optimize the steam pushing effect, number of power reinforcers 30, 32, 34, and 36 can be increased.

The industrial applications of the power reinforcers, 30, 32, 34, and 36, is not limited to the reinforcement of steam only, but also of other forces, such as water, liquid, gas, air, etc.

Active steam momentum cannot be harnessed mechanically in circulation, but can be harnessed by itself and guided with one-way funnels, inside each of pipes 2*a*-2*b*, 4*a*-4*b*, 6*a*-6*b*, 8*a*-8*b*, 10*a*-*b*, 12*a*-*b*, 14*a*-*b*, 16*a*-*b*, 20*a*-*h*, 22*a*-*h*, 24*a*-*h*, and 26*a*-*h*. Each of the one way funnels may have a larger end opening and a smaller end opening. Steam expansion pressure at the larger end opening of each one-way funnel, is greater than that at the smaller end opening. The pressure difference secures the flow of steam from the larger end opening to the smaller end opening of one-way funnel, such as one of one way funnels 40*a*-*c*, and 42*a*-*c* in FIG. 2. The components 51*a*-*d* are valves shown in FIG. 5.

The initial steam momentum goes along with the direction of one-way funnels in one way. The steam pushing effect generated by the power reinforcers, 30, 32, 34, and 36 then can push steam forward inside the pipes with the direction of steam momentum in one way.

The industrial applications of one-way funnels installed inside the pipes, is not limited to harness and guide steam only, but also to harness and guide other forces, such as gas, water, liquid, air, etc.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first pipe steamer device comprised of a first ring which is closed except for a first plurality of openings and a first steam pipe connection opening;

a first steam pipe;

a first water pipe; and a first heating element;

wherein the first steam pipe has a proximal end which is connected to the first steam pipe connection opening and a distal end which is connected to a proximal end of the first water pipe;

wherein the first water pipe is located adjacent to the first heating element;

wherein the first ring includes a first ring shaped inner wall, a first ring shaped outer wall, a first ring shaped wall structure including the first ring shaped inner wall and the first ring shaped outer wall, and a first ring shaped chamber enclosed by the first ring shaped wall structure, except for the first plurality of openings and the first steam pipe connection opening; and wherein the first plurality of openings and the first steam pipe connection opening are openings through the first ring shaped wall structure into the first ring shaped chamber.

2. The apparatus of claim 1 wherein each of the first steam pipe and the first water pipe have a spiral shape.

3. The apparatus of claim 1 further wherein the first pipe steamer device is further comprised of a first steam pipe container, wherein the first steam pipe is located in the first steam pipe container; and a first water pipe container, wherein the first water pipe is located in the first water pipe container.

4. The apparatus of claim 3 wherein each of the first steam pipe container and the first water pipe container has a bowl shape;

and wherein the first steam pipe container is connected to the first water pipe container to form a first combination device container which has an hourglass shape.

5. The apparatus of claim 1 further comprising a second pipe steamer device comprised of a second ring which is closed except for a second plurality of openings and a second steam pipe connection opening;

a second steam pipe;

a second water pipe; and a second heating element;

wherein the second steam pipe has a proximal end which is connected to the second steam pipe connection opening and a distal end which is connected to a proximal end of the second water pipe; and wherein the second water pipe is located adjacent the second heating element;

wherein the second ring includes a second ring shaped inner wall, a second ring shaped outer wall, a second ring shaped wall structure including the second ring shaped inner wall and the second ring shaped outer wall, and a second ring shaped chamber enclosed by the second ring shaped wall structure, except for the second plurality of openings and the second steam pipe connection opening; and wherein the second plurality of openings and the second steam pipe connection opening are openings through the second ring shaped wall structure into the second ring shaped chamber;

and further comprising a first power reinforcer device comprised of a first sack and a second sack;

wherein the first power reinforcer device is connected to the first pipe steamer device and the second pipe steamer device;

wherein the first power reinforcer device is configured to allow flow of steam into the first sack from the first pipe steamer device, but to block flow of steam out of the first sack into the first pipe steamer device during a first state;

wherein the first power reinforcer device is configured to block flow of steam into the second sack from the second pipe steamer device, but to allow flow of steam from the second sack into the second pipe steamer device during the first state; and wherein the first power reinforcer is configured so that flow of steam into the first sack from the first pipe steamer device causes steam to be squeezed out of the second stack into the second pipe steamer device during the first state.

6. The apparatus of claim 5 wherein wherein the first power reinforcer device is configured to block flow of steam into the first sack from the first pipe steamer device, but to allow flow of steam out of the first sack into the first pipe steamer device during a second state;

wherein the first power reinforcer device is configured to allow flow of steam into the second sack from the second pipe steamer device, but to block flow of steam from the second sack into the second pipe steamer device during the second state; and wherein the first power reinforcer is configured so that flow of steam into the second sack from the second pipe steamer device causes steam to be squeezed out of the first stack into the first pipe steamer device during the second state.

7. The apparatus of claim 5 further comprising a first plurality of one way funnels located in the first ring shaped chamber of the first ring; and wherein each of the first plurality of one way funnels permits fluid flow in the first ring shaped chamber of the first ring in only a first rotational direction;

and further comprising a second plurality of one way funnels located in the second ring shaped chamber of the second ring; and wherein each of the second plurality of one way funnels permits fluid flow in the second ring shaped chamber of the second ring in only a second rotational direction, which is opposite the first rotational direction.

8. The apparatus of claim 1 further comprising a first steam application station connected to the first pipe steamer device through a first opening of the first plurality of openings of the first ring; and wherein the first steam application station receives steam from the first pipe steamer device through the first opening of the first plurality of openings of the first ring and generates electrical power using the steam from the first pipe steamer device.

9. The apparatus of claim 8 further comprising a second steam application station connected to the first pipe steamer device through a second opening of the first plurality of openings of the first ring;

wherein the second steam application station receives steam from the first pipe steamer device through the second opening of the first plurality of openings of the first ring and generates electrical power using the steam from the first pipe steamer device.

10. The apparatus of claim 1 further comprising a first plurality of one way funnels located in the first ring shaped chamber of the first ring; and wherein each of the first plurality of one way funnels permits fluid flow in the first ring shaped chamber of the first ring in only a first rotational direction.

11. A method comprising heating water in a first water pipe located in a first water pipe container so that the water in the first water pipe turns into steam;

directing steam from the first water pipe into a first steam pipe located in a first steam pipe container;

directing steam from the first steam pipe into a first steam pipe ring, wherein the first steam pipe ring is closed except for a first plurality of openings and a first steam pipe connection opening; and supplying steam from the first steam pipe ring to a first steam application station through a first opening of the first plurality of openings of the first steam pipe ring;

and causing the first steam application station to generate electrical power using steam received from the first steam pipe ring and through the first opening of first plurality of openings of the first steam pipe ring; and wherein the first steam pipe has a proximal end which is connected to the first steam pipe connection opening and a distal end which is connected to a proximal end of the first water pipe;

wherein the first steam pipe ring includes a first ring shaped inner wall, a first ring shaped outer wall, a first ring shaped wall structure including the first ring shaped inner wall and the first ring shaped outer wall, and a first ring shaped chamber enclosed by the first ring shaped wall structure, except for the first plurality of openings and the first steam pipe connection opening; and wherein the first plurality of openings and the first steam pipe connection opening are openings through the first ring shaped wall structure into the first ring shaped chamber.

12. The method of claim 11 wherein the first water pipe is in a spiral shape.

13. The method of claim 11 wherein the first steam pipe is in a spiral shape.

14. The method of claim 11 further comprising directing steam from the first steam pipe ring to a first sack of a first power reinforcer through a second opening of the first plurality of openings of the first steam pipe ring.

15. The method of claim 11 further comprising heating water in a second water pipe located in a second water pipe container so that the water in the second water pipe turns into steam;

directing steam from the second water pipe into a second steam pipe located in a second steam pipe container;

directing steam from the second steam pipe into a second steam pipe ring, wherein the second steam pipe ring is closed except for a second plurality of openings and a second steam pipe connection opening; and supplying steam from the second steam pipe ring to a second steam application station through a first opening of the second plurality of openings of the second steam pipe ring;

and causing the second steam application station to generate electrical power using steam received from the second steam pipe ring and through the first opening of second plurality of openings of the second steam pipe ring; and wherein the second steam pipe has a proximal end which is connected to the second steam pipe connection opening and a distal end which is connected to a proximal end of the second water pipe;

wherein the second steam pipe ring includes a second ring shaped inner wall, a second ring shaped outer wall, a second ring shaped wall structure including the second ring shaped inner wall and the second ring shaped outer wall, and a second ring shaped chamber enclosed by the second ring shaped wall structure, except for the second plurality of openings and the second steam pipe connection opening; and wherein the second plurality of openings and the second steam pipe connection opening are openings through the second ring shaped wall structure into the second ring shaped chamber.

16. The method of claim 15 further comprising allowing the flow of steam from the first steam pipe ring into a first sack of a first power reinforcer during a first state;

blocking the flow of steam from the first sack of the first power reinforcer into the first steam pipe ring during the first state;

blocking the flow of steam from the second steam pipe ring to a second sack of the first power reinforcer during the first state;

and allowing the flow of steam from the second sack of the first power reinforcer into the second steam pipe ring during the first state; and wherein the first power reinforcer is configured so that flow of steam into the first sack from the first steam pipe ring causes steam to be squeezed out of the second stack into the second pipe steam pipe ring during the first state.

17. The method of claim 16 wherein the first power reinforcer device is configured to block flow of steam into the first sack from the first steam pipe ring, but to allow flow of steam out of the first sack into the first steam pipe ring during a second state;

wherein the first power reinforcer device is configured to allow flow of steam into the second sack from the second steam pipe ring, but to block flow of steam from the second sack into the second steam pipe ring during the second state; and wherein the first power reinforcer is configured so that flow of steam into the second sack from the second steam pipe ring causes steam to be squeezed out of the first stack into the first steam pipe ring during the second state.

18. The method of claim 15 wherein a first plurality of one way funnels are located in the first ring shaped chamber of the first ring; and wherein each of the first plurality of one way funnels permits fluid flow in the first ring shaped chamber of the first steam pipe ring in only a first rotational direction;

wherein a second plurality of one way funnels are located in the second ring shaped chamber of the second steam pipe ring; and wherein each of the second plurality of one way funnels permits fluid flow in the second ring shaped chamber of the second steam pipe ring in only a second rotational direction, which is opposite the first rotational direction.

19. The method of claim 11 wherein a first plurality of one way funnels are located in the first ring shaped chamber of the first steam pipe ring; and wherein each of the first plurality of one way funnels permits fluid flow in the first ring shaped chamber of the first steam pipe ring in only a first rotational direction.

* * * * *